United States Patent [19]

Hasegawa et al.

[11] 4,344,466

[45] Aug. 17, 1982

[54] FLEXIBLE TYPE RAPIER LOOM

[75] Inventors: Junzo Hasegawa, Obu; Susumu Kawabata, Aichi; Kiichi Kono, Toyota; Tetsuzo Inoue, Nagoya, all of Japan

[73] Assignee: Kabushiki Kaisha Toyota Chuo Kenkyusho, Nagoya, Japan

[21] Appl. No.: 143,335

[22] Filed: Apr. 24, 1980

[30] Foreign Application Priority Data

May 2, 1979 [JP] Japan ..... 54-54261

[51] Int. Cl.[3] ..... D03D 47/12

[52] U.S. Cl. ..... 139/449

[58] Field of Search ..... 139/134, 429, 437, 443, 139/444, 445, 446, 449; 74/230.1, 230.5

[56] References Cited

U.S. PATENT DOCUMENTS 2,810,430 10/1957 Sanderson et al. ..... 139/449

FOREIGN PATENT DOCUMENTS 2502692 9/1975 Fed. Rep. of Germany ..... 139/449

*Primary Examiner*—Henry Jaudon

*Attorney, Agent, or Firm*—Oblon, Fisher, Spivak, McClelland & Maier

[57] ABSTRACT

A flexible type rapier loom having a loom body in which a shed is formed in warp threads, a wheel rotatably mounted on the loom body and oscillatedly driven back and forth, a flexible tape of a magnetic and elastic material attached at one end thereof to a circumference of the wheel and carrying a weft holder at the other end thereof, and a plurality of magnetic attracting mechanisms provided on the outer circumference of the wheel to attract the flexible tape to the outer circumference of the wheel by strong magnetic forces, thereby inserting the flexible tape into the shed and withdrawing the flexible tape from the shed to insert a weft into the shed in an assured manner even at a high speed operation of the loom.

15 Claims, 16 Drawing Figures

FLEXIBLE TYPE RAPIER LOOM

BACKGROUND OF THE INVENTION

1. Field of the Invention

This invention relates to shuttleless looms of the type in which a weft is inserted into a warp shed by the reciprocal movements of its carrying holder, and more particularly, to a flexible type rapier loom in which the reciprocal movements of the weft carrying holder are effected by a reciprocally rotatable wheel and a flexible tape having elasticity.

2. Description of the Prior Art

The general construction of the flexible type rapier loom will be described with reference to FIGS. 1 and 2. The aforementioned weft holder 7 is fixed to one end of an elastic flexible tape 1, which assumes a straight shape under its normal condition, so that it is moved back and forth within the shed while having the aforementioned tape 1 guided by a straight guide 11 which is fixed to a loom body 10. The other end of the tape 1 is fixed to the outer circumference of a wheel 2 which is rotatably mounted in a supporting bracket 12 of a wheel cover fixed to the loom body 10. Thus, the tape 1 is wound on the outer circumference of the wheel 2 by the rotation of the wheel 2 in one direction or unwound therefrom by the rotation of the wheel 2 in the other direction, while being guided by a tangential guide 9 fixed to the loom body 10, so that it is let off tangentially of the wheel 2 thereby to move the aforementioned weft holder back and forth within the shed.

In order that the elastic flexible tape may be wound in a curved shape on the outer circumference of the wheel and let off tangentially of the wheel, generally speaking, as shown in FIG. 2, guides 13, 14, 15, 16, 17, 18 and 19 having a slightly larger curvature than that of the outer circumference of the wheel are fixed outside of the wheel circumference to the supporting bracket 12 so that the tape 1 is guided by guides 13 to 17 as well as the aforementioned tangential and straight guides 9 and 11.

According to this construction, the tape 1 is slid, while partially abutting against the inner sides of the guides 13 to 17 and the tangential guide 9, without being moved back and forth in contact with the outer circumference of the wheel 2, in accordance with its reciprocal movements due to the reciprocal rotations of the wheel 2, mainly because of the centrifugal force during its movements, its reaction when it is curved into an arcuate shape along the wheel, as well as the components of forces at the fixed point of the tape 1 to the wheel 2 when it is to be let off and wound. Those abutting slides produce high frictional sliding so that the tape is heated, the tape and the guides are worn, and the power loss is very high. This influence becomes the more prominent as the machine is driven at the higher speed, thus inviting one of the major causes for preventing the speed of the rapier loom from being increased.

For purposes of knowing that influence, the Inventors have conducted the following experimental exemplifications. More specifically, the mechanism shown in FIG. 2 was attached to the rapier loom and was driven so that the forces for the stationary guides 13, 14, 15, 16 and 17 to be pressed at a right angle by the tape during the drive were measured. In these experiments, the loom was run without the use of the warp and weft. One example of the experiments is illustrated in FIG. 3. As is apparent from FIG. 3, the stationary guide located the closer to the fixed end of the tape 1 to the wheel 2, is subjected to the stronger pressing force.

On the other hand, the results in which the power A consumed by the rapier loom under its full load running condition and the power B consumed by the same under the condition having the tape removed were measured with the R.P.M. of the machine being varied are plotted in FIG. 4. As is apparent from the FIGURE, the power consumption A during the full load running operation is markedly higher than the power consumption B in case the machine is run with the tape being removed, and the difference A-B is the power consumption due to the movements of the tape and is mostly the power loss due to the sliding frictional resistance between the tape and the stationary guides 13 to 17, i.e., a kind of the braking action of the stationary guides upon the run of the tape.

Upon examination of FIG. 4, it is found that more than 50% of the power loss during the full load running operation comes from the movements of the tape. Since, moreover, most of the power loss due to the movements of the tape is the sliding frictional resistance, in order to improve the power consumption and the durabilities of the tape and the stationary guides, it can be said that reduction in the frictional resistance between the tape and the stationary guides is remarkably effective and leads to the speed-up of the rapier loom.

As a trial to reduce the aforementioned sliding frictional resistance, there is an invention which is disclosed in U.S. Pat. No. 2,810,403. According to the invention disclosed, a rim made of a non-magnetic thin plate is fixed to the outer circumference of the aforementioned wheel in a manner to overhang in an annular shape at one side thereof, and one end of the aforementioned tape is fixed to the rim so that it may be wound on the circumference of the rim. On the other hand, a number of magnets (e.g. permanent magnets or electromagnets) are attached in a circular shape to the supporting bracket which is fixed to the loom body while also acting as a fitting for a wheel cover, and are arranged on the diametrically inner side of the aforementioned rim such that both poles are made to face the inner side of the aforementioned rim at a slight spacing therefrom. According to the prior art thus constructed, the magnetic tape is attracted to and retained on the outer circumference of the rim, when it is curved along the curvature of the rim of the wheel, by the attracting forces of the magnets, which are fixed to the bracket at the diametrically inner side positions of the rim, so that the tape is kept away from contact with the stationary guide, when it is located on the curvature of the rim, thus intending to eliminate the sliding frictional resistance inbetween. A considerable spacing is, however, required between the tape and the magnets for eliminating the sliding frictional resistance between the reciprocating tape and the stationary magnets, in other words, the sliding frictional resistance between the wheel or the rim and the magnets.

Generally speaking, in case a magnetic member is attracted and held in position by making use of the attracting force of a magnet, this attracting force of the magnet is decreased in proportion to the square of the distance of the gap, if any, between the magnetic member and the magnetic poles of the magnet. Therefore, the decrease in the attracting force in this case is surprising as compared with the case in which the magnetic member is attracted in contact with the magnetic poles. In the invention disclosed in the aforementioned United States Patent, a considerable attracting force is required for holding the metal tape having a width of 25 mm and a thickness of 0.8 mm, which is being generally used at present, on the outer circumference of the rim along the curvature of the wheel. If, moreover, the wheel is swung back and forth in accordance with the drive of the loom, the tape is oscillated diametrically and circumferentially of the wheel so that the spacing from the poles of the magnets fixed to the supporting bracket is varied. As a result, the attracting forces of the magnets are so markedly varied as to make it difficult to hold the tape on the outer circumference of the rim of the wheel.

SUMMARY OF THE INVENTION

It is therefore an object of the present invention to hold the tape of a flexible type rapier loom during its operation on outer circumference of the wheel without fail by the magnets which are fixed to the wheel. According to the present invention, the tape is kept free from the actions of other stationary guides within the range in which it is wound on the wheel. As a result, the stationary guides are almost dispensed with to reduce necessarily the friction between the tape and the stationary guides so that the power consumption can be improved and so that the tape can have its durability improved while being prevented from being heated.

Further, the tape can be held on the wheel in an assured and stable manner without the influence of the acceleration, centrifugal force, or the variations of spacing from the poles of magnets to the wheel, even at a high speed operation of the rapier loom.

More specifically, the present invention relates to improvements in a shuttleless loom, especially, in a flexible type rapier loom in which the aforementioned wheel is borne in a rotatable manner, in which a tape carrying a weft holder at one end and made of an elastic material has its other end fixed to the circumference of the wheel, and in which the wheel is rotationally driven back and forth so that the tape is moved back and forth such that it can be inserted into and withdrawn from a shed formed in warp threads thereby to insert a weft thereinto. The flexible type rapier loom according to the present invention is characterized in that the tape is made of a magnetic and elastic material, in that magnets are fixed to the outer circumference of the wheel, at a suitable spacing from each other, such that both positive and negative poles appear in the vicinity of the outer circumference of the wheel, and in that a closed circuit magnetic path is made up of the tape along the circumference of the wheel and each magnet.

In the general flexible type rapier loom as shown in its diagrammatical front elevation in FIG. 1, the present invention contemplates to improve the wheel so that magnets are arranged in a row on the whole outer circumference of the wheel or at a suitable spacing from each other to take up the tape such that the magnets are made rotatable integrally with the wheel while attracting and holding the tape or the magnetic member to and on the outer circumference of the wheel. On the other hand, since both of the positive and negative poles of the aforementioned magnets are arranged in the vicinity of the circumference of the wheel, a closed circuit is made up of each magnet and the tape, and the spacing between the tape and the magnetic poles is not substantial so that the tape can be held by the sufficiently strong attracting force. Especially when the magnetic poles are made to have the same curvature as that of the outer circumference of the wheel, the abutment surface areas between the tape and the magnetic poles are formed so large that a markedly strong attracting force can be generated.

The wheel to be used in the present invention should not be limited to the vehicular wheel type which has been conventionally used to include a rim and spokes but can be of a disk shape or a rotor having an outer circumference of preset curvature and width if it is so designed as to have sufficient mechanical strength and a small moment of inertia. On the other hand, the wheel is made of a non-magnetic material.

BRIEF DESCRIPTION OF THE DRAWINGS

Various other objects, features and advantages of the present invention will be apparent from the following detailed description when considered in connection with the accompanying drawings, in which like reference characters designate like or corresponding parts throughout the several views, and wherein.

DESCRIPTION OF THE PREFERRED EMBODIMENTS

Figure 1:
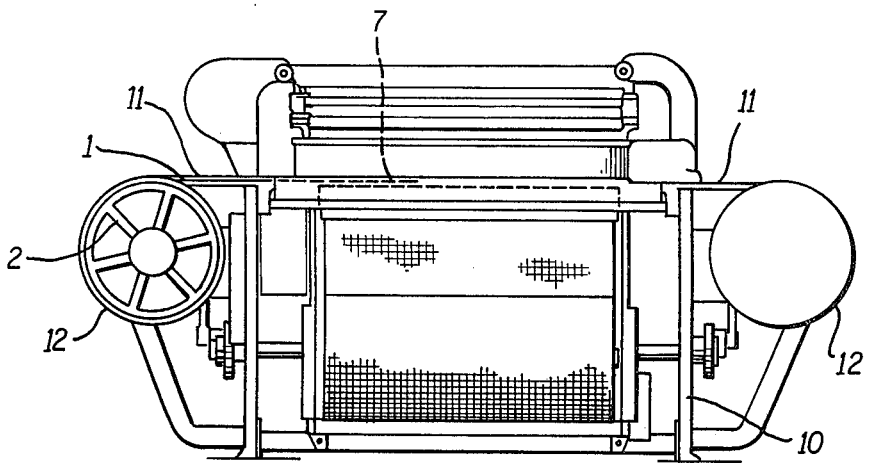
FIG. 1 PRIOR ART
FIG. 1 is a diagrammatical front elevation of the flexible type rapier loom according to the present invention and the prior art.

The present invention will be described in the following in connection with the embodiments thereof. The diagrammatical front elevation of the flexible type rapier loom according to the present invention is not especially different from the general one shown in FIG. 1.

Figure 5:
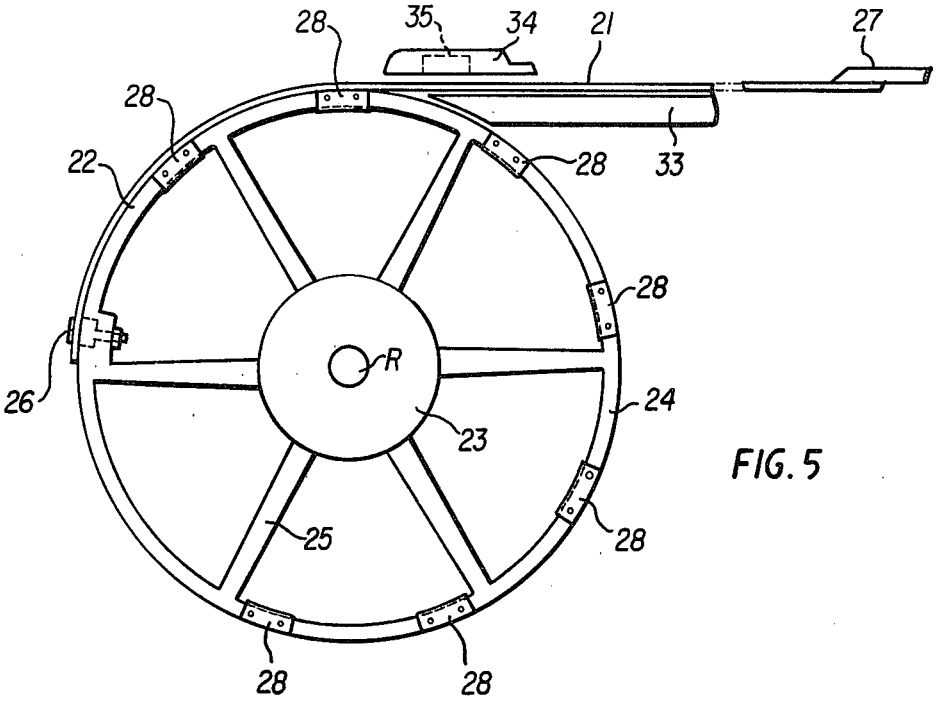
FIG. 5 is a front elevation showing the wheel and tape according to the first embodiment of the present invention.

According to the first embodiment of the present invention, as shown in FIG. 5, a wheel 22 having fixed thereto one end of a flexible tape 21 made of a magnetic material is made up of a hub 23 which is mounted on a shaft R rotationally driven back and forth, an annular rim 24 and spokes 25 which connect the hub 23 and rim 24. One end of the aforementioned tape is fixed to the outer circumference of the aforementioned rim 24 by means of a fitting 26 such as a bolt. The tape 21 is so arranged that its longitudinal direction is wound on the outer circumference of the rim 24.

The tape 21 is made of a magnetic material having sufficient elasticity and flexibility such as spring steel. The tape 21 thus made is formed into such a planar shape that it keeps its straightness under its free condition and has its free end fixed to a weft holder 27.

There are arranged on the annular rim 24 of the wheel 22 a plurality of magnetic attracting mechanisms 28 including magnets, which are disposed at positions spaced about 30 to 45 degrees about the center of rotation of the wheel 22 from the position close to the fixed point of the tape 21. Each of the magnetic attracting mechanisms is made up of a unit magnet 31 in which a permanent magnet or magnets 29 magnetized thicknesswise with positive and negative poles is sandwiched between two yoke plates 30, as is apparent from the top plan view shown in FIG. 6 and the sectional view shown in FIG. 7. The unit magnets 31 are arranged at three positions, i.e., at the two side edges of the rim and in a groove 32 formed in the rim and are fitted to the rim 24 by bolts and nuts. The unit magnets 31 are arranged such that their upper edges are at the same level as that of the outer circumferential edges of the rim 24.

Figure 8:
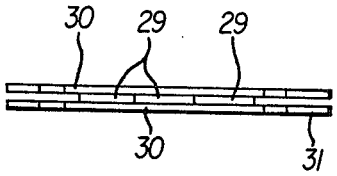
FIG. 8 is an upper side view showing a unit magnet to be used in the embodiment.
Figure 9:
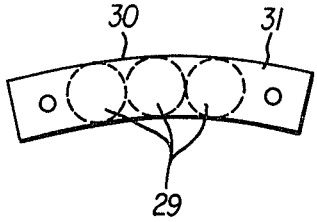
FIG. 9 is a side elevation of the unit magnet.

As is apparent from the top plan view shown in FIG. 8 and the side elevation shown in FIG. 9, each unit magnet 31 is so constructed that the yoke plates 30 have the same curvature at their upper edges as that of the outer circumference of the rim 24 and is so arranged that the permanent magnets 29 are inscribed with the upper edges of the yoke plates 30.

Figure 7:
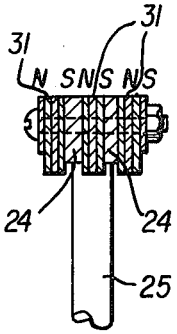
FIG. 7 is a sectional view of FIG. 6.
Figure 6:
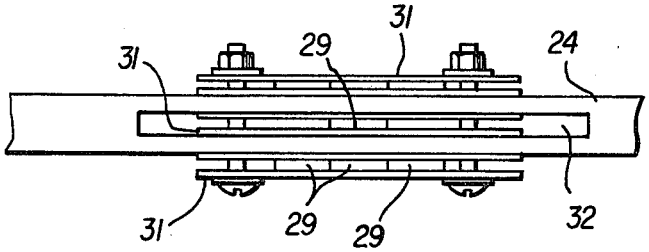
FIG. 6 is an upper side view showing an essential portion of FIG. 5.

In the embodiment being described, a cobalt magnet of a rare earth element is employed as the permanent magnet and is formed into a disk shape which is sized to have a diameter of 10 mm and a thickness of 1.5 mm and which is magnetized thicknesswise with positive and negative poles. A magnetic plate, which has an outer circumference diameter of 458 mm, an inner circumference diameter of 434 mm and a thickness of 1 mm and which is cut to have an outer circumference length of 50 mm, is used as the yoke plates 30. In FIGS. 6 and 7, moreover, the unit magnets in each of which the three permanent magnets 29 are juxtaposed in a sandwiched manner are arranged on the both sides of the rim 24, and the unit magnet in which the single permanent magnet is sandwiched is arranged in the center groove 32 of the rim 24, thus constituting the magnetic attracting mechanism 28. As a result, the magnetic attracting mechanism 28 at one position is composed of six yoke plates and seven permanent magnets. In the present embodiment, the magnetic attracting mechanism 28 thus constituted are arranged at seven positions, as shown in FIG. 5.

According to the present embodiment thus far described, if the wheel 22 is turned counter-clockwise as viewed in FIG. 5, the tape 21 is moved leftwardly of the drawing so that the weft holder 27 is retracted from the shed. If, on the other hand, the wheel 22 is turned clockwise, the tape 21 is separated by a tangential guide 33 and let off rightwardly in a straight form along a straight stationary guide 34 so that the weft holder 27 is inserted into the shed. Those guides 33 and 34 are attached to the same positions as those of the guides 9 and 11 of FIG. 2. In this meanwhile, the tape 21 is attracted and held by the magnetic attracting mechanism 28 along the outer circumference of the wheel 22 (or the rim 24) from the end fixed to the wheel 22 by the fitting 26 so that it is kept from sliding contact with any stationary structure such as the loom body or the stationary guide except that it slightly contacts with the tangential guide 33 and the straight guide 34 when it is separated from the wheel. If a magnet 35 is fixed to the straight stationary guide 34 so as to attract the tape 21, this tape 21 is separated in the diametrical direction from the wheel so that its friction with the tangential guide 33 is reduced.

Figure 2:
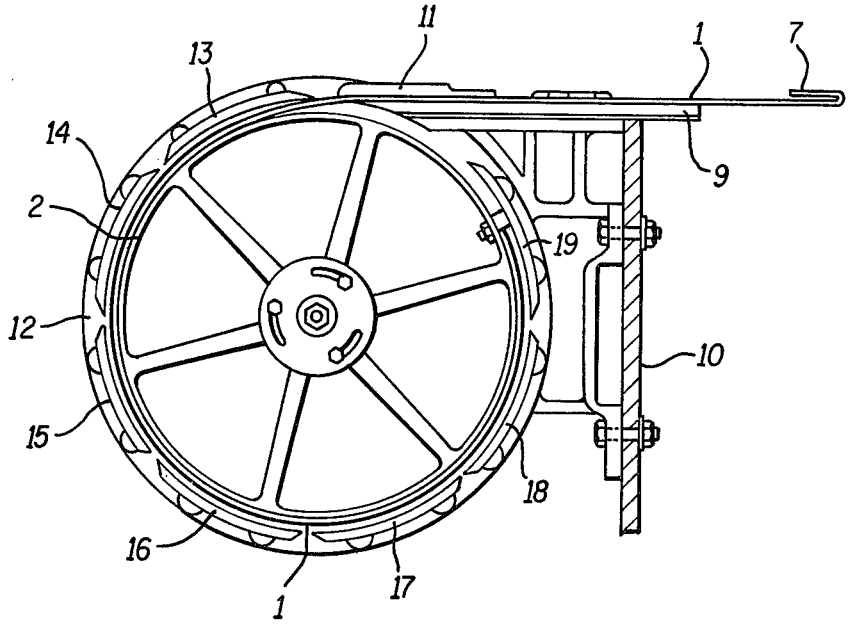
FIG. 2 PRIOR ART
FIG. 2 is a plan view showing the wheel and tape which are used in the conventional machine.
Figure 3:
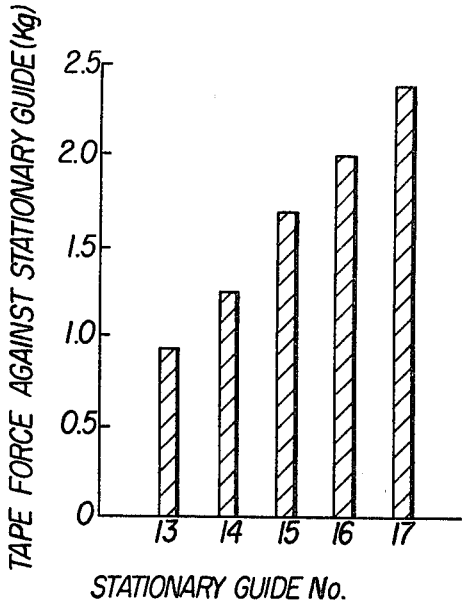
FIG. 3 PRIOR ART
FIGS. 3 and 4 are explanatory views showing the forces and the power consumptions in case the conventional loom is run under varied conditions.
Figure 4:
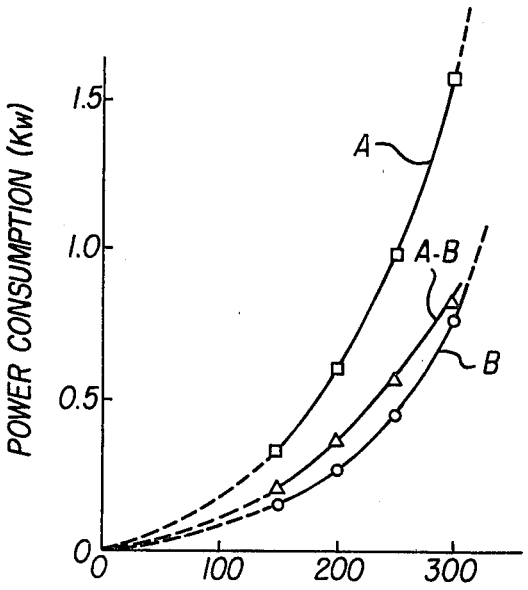
FIG. 4 PRIOR ART
Figure 10:
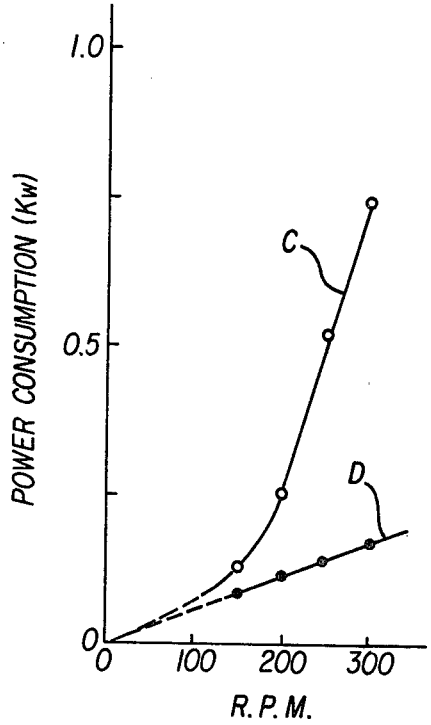
FIG. 10 is a chart comparing the power consumptions in case the wheels according to the present invention and the prior art are driven under an identical condition.

FIG. 10 shows the results, in which both the conventional wheel shown in FIG. 2 and having no magnet attached thereto and the wheel according to the first embodiment of the present invention as shown in FIG. 5 were alternately attached to an identical rapier loom and driven under an identical condition so that the powers consumed during the drives were measured. In the case of these experiments, the loom was run without the use of the warp and weft similarly to the experiments of FIG. 4.

It is apparent from FIG. 10 that the power consumed by the wheel according to the present invention is very low when comparing the power consumption curve C in case of the conventional type wheel with the power consumption curve D in case of the wheel of the present invention.

This can be explained by the following reasoning. As shown in FIG. 2, a plurality of the stationary guides 13, 14 15, 16, 17 and 18 are fixed to the supporting bracket 12 of the wheel cover of the loom according to the prior art. Both the conventional type wheel and the wheel according to the present invention were rotationally driven within those stationary guides. In the forms case, however, the conventional type wheel was used and driven, and the tape 1 was separated from the outer circumference of the rim and brought into frictional sliding contact with the stationary guides. On the contrary, in the latter case the wheel according to the present invention was used and driven, and the tape was held on the outer circumference of the rim 24 of the wheel 22 so that its sliding resistance with the stationary guides was remarkably reduced as compared with that in the former case. Moreover, although the tape 1 attached to the conventional type wheel was heated to a considerably high temperature by the heat due to friction, the tape 21 attached to the wheel of the present invention was little heated. In view of the foregoing facts, the rapier loom according to the present invention can be made to dispense with any stationary guide except both the tangential guide for orienting the tape 21 in the tangential direction and the straight stationary guide for guiding the same into the shed.

Further, since in the present invention magnetic attracting mechanisms are directly fixed to the wheel, the tape can be attracted to the wheel by much stronger attracting forces, as compared with the conventional rapier loom of the type in which magnets are fixed to the stationary structure such as a supporting bracket secured to the loom body which requires leaving a sufficient spacing between the wheel and the magnets. This feature of the present invention is especially important at a high speed operation of the rapier loom where strong attracting forces are required to attract the tape to the wheel so as to resist the strong centrifugal forces caused.

Moreover, in the conventional rapier loom, a spacing between the wheel and the magnets is varied due to the diametrical and circumferential oscillation of the wheel during the operation, resulting in attracting forces that are insufficient at a large spacing. According to the present invention, however, attracting forces are uniform and sufficient around the wheel even at a high speed operation of the rapier loom due to the direct attachement of the magnetic attracting mechanism to the wheel.

Figure 11:
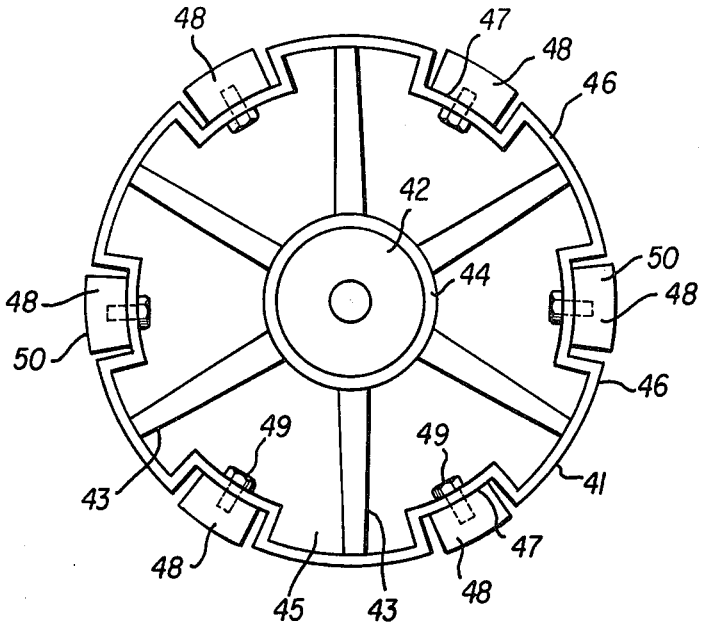
FIG. 11 is a plan view showing the wheel according to the second embodiment of the present invention.

FIG. 11 shows the second embodiment of the present invention, i.e. a modification of the aforementioned wheel shown in FIG. 5. A side wall 45 from which a rim 41, a hub 42, spoke-shaped protrusions 43 and an annular hub protrusion 44 protrude integrally is molded of a non-magnetic material such as an aluminum alloy. The rim 41 is formed integrally and alternately with larger curvature circumferential portions 46 and smaller curvature circumferential portions 47, which are arranged at a preset spacing inbetween. (In this instance, the side wall 45 can be omitted by constituting the protrusions 43 into intrinsic spokes.) In this modification, magnetic attracting mechanisms 48 are attached to the smaller curvature circumferential portions 47 by means of fittings 49. In each of this magnetic attracting mechanisms 48, although not specifically shown, the unit magnets 31 shown in FIGS. 8 and 9 are filled in a casing 50 having its upper side opened and are arranged such that the upper edges of the unit magnets are coextensive with the open side of the casing 50 and that the open side of the casing 50 is located at the plane having the same curvature as that of the outer circumference of the rim 41.

Figure 12:
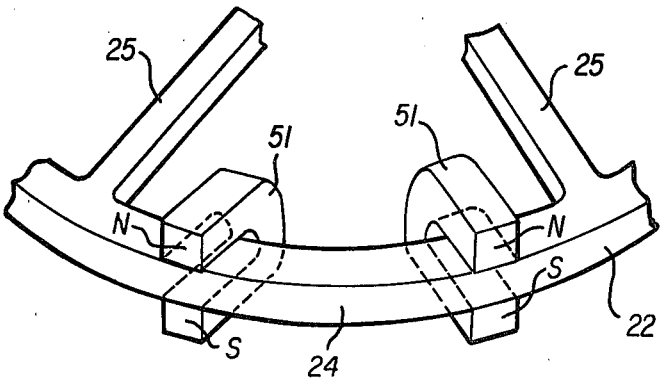
FIGS. 12 and 13 are perspective views showing essential portions of the wheels according to the third and fourth embodiments of the present invention.

FIG. 12 shows a third embodiment of the present invention, i.e. another modification of the wheel shown in FIG. 5, in which a suitable number of U-shaped permanent magnets 51 are fixed in place of the magnetic attracting mechanism 28 at a suitable spacing inbetween to the annular rim 24 by fixing mechanism. In this embodiment, substantially the same effects as those of the embodiment shown in FIG. 5 can be attained. The same effects can also be attained by using the electromagnets in place of the permanent magnets and by magnetizing them with suitable mechanisms.

FIGS. 13 to 16 show the essential portions of other embodiments of the present invention, in which the attracting forces of the magnetic attracting mechanisms formed in the wheel are made variable. These embodiments intend to retain the attracting forces in the magnetic attracting mechanisms while they are disposed at the positions where the tape is held in a curved shape along the outer circumference of the wheel, and to eliminate those attracting forces when any magnetic attracting mechanisms is moved by the rotations of the wheel to the position where the tape is to move in the tangential direction from the outer circumference of the wheel, i.e., to the position just below the straight stationary guide 34 or closer than that to the loom body.

Figure 13:
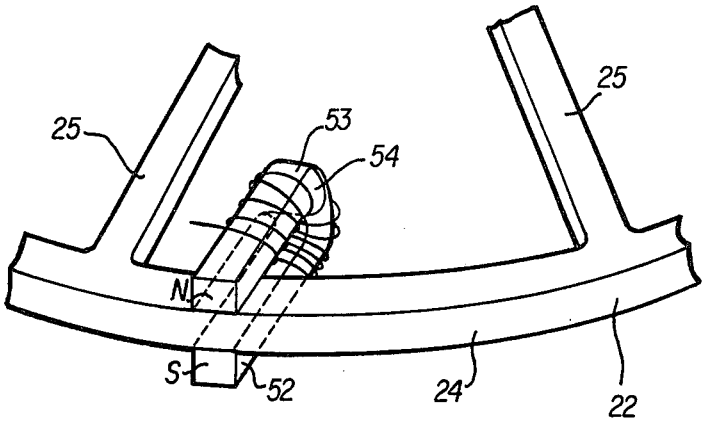

In the fourth embodiment shown in FIG. 13, an electromagnet 54 in which a magnetizing coil 53 is wound on a U-shaped magnetic core 52 is fixed to the annular rim 24 of the wheel 22 shown in FIG. 5 such that its positive and negative poles are coextensive with the outer circumference of the rim 24. As a result, the tape can be attracted to and held on the outer circumference of the wheel 22 by energizing the magnetizing coil 53.

In the present embodiment, in order to energize the magnetizing coil 53, an arcuate electrode is attached in an insulated manner to the hub 23 of the wheel 22, and a stationary brush is brought into contact with the electrode thereby to supply an electric current from a power source.

In the present embodiment, moreover, if the energization of the magnetizing coil 53 is interrupted when the magnet 54 is moved in accordance with the rotations of the wheel to a position either just below the straight stationary guide 34 or closer to the loom body, the electromagnet 54 is demagnetized so that the tape tends to assume its straightened shape due to its own elasticity and is shifted into its straight reciprocal movements within the shed through the straight stationary guide. With those construction arrangements, the resistance to the tape which tends to move tangentially against the attracting force due to the magnetic forces at the outer circumference of the wheel is reduced while sparing the power consumption.

In the present embodiment, moreover, if the U-shaped magnetic core 52 is made of a permanent magnet, the tape is attracted to and held on the outer circumference of the rim 24 of the wheel 22 by the magnetic force of the permanent magnet while the magnetizing coil 53 is being de-energized. If, however, this magnetizing coil 53 is energized when the permanent magnet comes to a position either just below the straight stationary guide 34 or closer to the loom body, the magnetic force of the permanent magnet is interrupted so that the tape can leave without any difficulty the outer circumference of the annular rim 24. On the contrary, when the tape is to be retracted from the shed and wound on the outer circumference of the wheel, the energization of the magnetizing coil 53 is interrupted when it comes to a position close to or just below the straight stationary guide 34 so that the magnetic force of the permanent magnet begins to attract the tape. The energization and deenergization of the magnetizing coil 53 are sufficiently performed by attaching the arcuate electrode in an insulated manner to the hub 23 of the wheel 22 so that the power may be supplied only at an angle of rotation at which the electrode is brought into contact with the stationary brush and by adjusting that angle of rotation to the power supply position of the aforementioned magnetizing coil 53. Incidentally, a flexible wire may be employed because the angle of reciprocal motions of the wheel is not so large.

Figure 14:
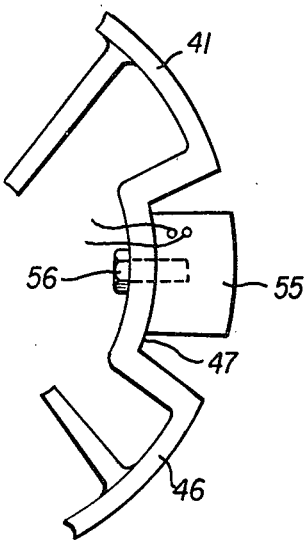
FIG. 14 is a side elevation showing an essential portion of the wheel according to the fifth embodiment of the present invention.
Figure 15:
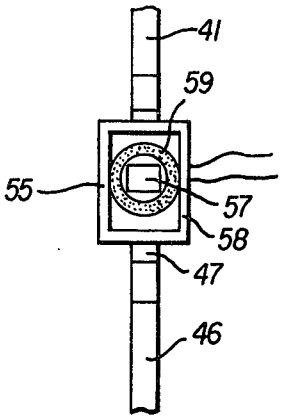
FIG. 15 is a front elevation showing the same.
Figure 16:
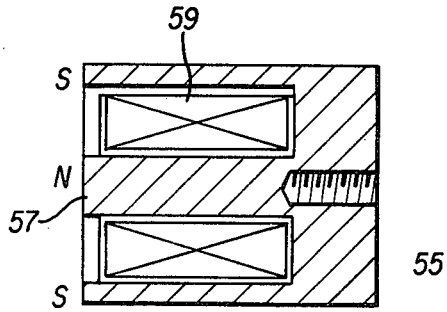
FIG. 16 is a sectional view showing the electromagnet thereof.

FIGS. 14 to 16 show the fifth embodiment, in which the wheel 41 shown in FIG. 11 is used and in which an electromagnet 55 is fixedly attached as the magnetic attracting mechanisms to each smaller curvature circumferential portion 47 of the aforementioned wheel 41 by the use of a fitting 56 such as a bolt. As is apparent from the top plan view shown in FIG. 15 and the sectional view shown in FIG. 16, electromagnet 55 is produced by winding a magnetizing coil 59 around the center polar plate 57 of an integral yoke casing 58 which has its one side opened and is attached to the wheel 41 such that the height of the center polar plate 57 of the casing 58 is made to have the same curvature as that of the larger curvature circumferential portions 46 of the rim. The electromagnet thus constructed is economical because the leak of its magnetic flux and the power consumption are low.

In this embodiment, the magnetizing coil 59 is magnetized by means of both the arcuate electrode, which is attached in an insulated manner to the hub 42 of the wheel 41, and a stationary brush. When the magnetizing coil 59 is to be magnetized at all times during the running operation of the loom, the same effects as those of the embodiment shown in FIG. 11 can be attained. Similarly to the description as to the embodiment shown in FIG. 13, the magnetizing coil 59 can be demagnetized when it comes to the position either just below the straight guide 34 or closer to the loom.

As has been described in detail hereinbefore, according to the present invention, in the flexible rapier loom of the type in which a wheel is turned back and forth so that a tape having one end fixed to the wheel and its other end carrying a weft holder may be inserted into and withdrawn from the shed, magnets are fixed to the outer circumference of the wheel so that they may rotate integrally with the wheel and their magnetic poles may appear in the vicinity of the outer circumference of the wheel, whereby a closed circuit of a magnetic path is built up of the aforementioned tape along the circumference of the wheel and each of the aforementioned magnets. As a result, the tape along the outer circumference of the wheel is attracted to and held on the outer circumference of the wheel by the magnetic force against the acceleration and centrifugal force due to the reciprocally rotational drives of the wheel. Since, moreover, the tape is attracted to and held on the outer circumference of the wheel while substantially abutting against both positive and negative poles of the magnet, the attracting force is so strong that the shifts and vibrations of the tape in the diametrical and circumferential directions of the wheel due to the rotational drives of the wheel are reduced to markedly low levels. The present invention can reduce remarkably the power loss during the running operation of the loom as compared with the prior art, thus making it possible to drive the rapier loom at a high speed.

In the conventional flexible type rapier loom, on the other hand, the stationary guides for preventing the tape from shifting radially off the wheel could not be dispensed with, and the sliding frictional resistance between the stationary guides and the tape was high. According to the present invention, on the contrary, since the tape is attracted to and held on the outer circumference of the wheel by the attracting force of the magnet, the tangential guide and the straight stationary guide necessary for separating the tape from the outer circumference of the wheel and for inserting it in a straight shape into the shed are required, but the other stationary guides can be wholly dispensed with. As a result, the frictional resistance between the tape and the stationary guides can be reduced in a prominent manner, which in turn leads to substantial reduction in the heat generation and the wear due to the friction of the tape. Therefore, the present invention can enjoy the resultant effects that the wear resistance and durability of the loom can be increased while making it possible to increase the running speed of the loom as a whole.

The present invention is exemplified by using the permanent magnet as the magnet, the assembly in which a plate-shaped magnetic member has both sides magnetized with both positive and negative poles and is sandwiched between the two yoke plates is used as the unit magnet. When a desired number of those unit magnets are attached to the outer circumference of the wheel at the desired positions thereof, the positive and negative poles are juxtaposed thicknesswise at a small spacing on the outer circumference of the wheel. As a result, the closed circuits of the magnetic path made up of the tape and the aforementioned magnets become intense, which is preferred for exemplification of the present invention. The magnets may be arranged substantially all over the circumference of the wheel.

In the case using the permanent magnet, on the other hand, if a permanent magnet is additionally fixed to the straight stationary guide which is mounted on the loom body so that the tape is attracted, when it leaves the wheel, by the attracting force of the permanent magnet added, the tape can be separated without any difficulty from the wheel irrespective of the attracting force of the permanent magnet fixed to the wheel so that its friction with the tangential guide can be reduced.

If, on the other hand, the electromagnet is used as the magnet, the magnet which has been attracting and holding the tape is demagnetized when it is brought to a position either just below the straight guide or closer to the loom body so that the tape can be easily guided by the straight stationary guide and moved back and forth within the shed without being influenced by the magnetic force of the magnet when it leaves the wheel.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A flexible type rapier loom comprising:

a loom body having a plurality of warp threads in which a shed is formed in said warp threads;

a wheel rotatably mounted on said loom body and oscillatedly driven back and forth and having an outer circumference;

a flexible tape which comprises an elastic and magnetic material fixed at one end thereof to said circumference of said wheel and fitted upon said circumference of said wheel and carrying a weft holder at the other end thereof;

means for inserting said flexible tape into said shed and withdrawing said flexible tape from said shed such that a weft is inserted into said shed; and a plurality of magnetic attracting means mounted on said circumference of said wheel to form a closed circuit magnetic path between said flexible tape along said circumference of said wheel and each of said magnetic attracting means, for attracting said flexible tape to said circumference of said wheel by magnetic forces.

2. A flexible type rapier loom according to claim 1, wherein:

said magnetic attracting means further comprise a plurality of permanent magnets.

3. A flexible type rapier loom according to claim 1, wherein:

said magnetic attracting means further comprise a plurality of electromagnets.

4. A flexible type rapier loom according to claim 3, wherein:

each of said electromagnets further comprises a U-shaped core, and coil means wound around said U-shaped core and connected to a power source, wherein said electromagnet is provided on said wheel, said wheel being interposed between two leg portions of said core.

5. A flexible type rapier loom according to claim 4, wherein:

said wheel comprises a hub rotatably mounted on said loom body and oscillatedly driven back and forth, a plurality of spokes projected from said hub, and an annular rim integrally connected to said spokes;

said loom further comprising a fitting wherein said one end of said flexible tape is fixed to an outer circumference of said rim by said fitting; and fixing means wherein a plurality of U-shaped electromagnets are disposed at positions spaced about 30 to 45 degrees about the center of rotation of said wheel by said fixing means and are arranged such that tip portions of said leg portions thereof are at the same level as that of said outer circumferential edges of said rim; and wherein each of said U-shaped electromagnets further comprises an arcuate electrode insulatedly attached to said hub of said wheel and a stationary brush which contacts with said arcuate electrode for supplying an electric current from said power source, thereby interrupting the energization of said coil means due to a shape of said arcuate electrode when said electromagnet reaches the position of a straight stationary guide which is monted on said loom body at a position where said flexible tape is separated from said wheel.

6. A flexible type rapier loom according to claim 3, wherein:

each of said electromagnets further comprises:

a core comprising a hollow member having a bottom portion and a center projection projected from said bottom portion, and coil means wound around said center projection of said core and connected to a power source.

7. A flexible type rapier loom according to claim 6, wherein:

said wheel further comprises a hub rotatably mounted on said loom body and oscillatedly driven back and forth, a plurality of spokes projected from said hub, and an annular and corrugated rim integrally connected to said spokes and having a plurality of concaved portions;

said loom further comprising:

fitting means wherein said one end of said flexible tape is fixed to an outer circumference of said rim by said fitting means;

a plurality of bolts, wherein each of said magnetic attracting means is disposed at each concave portion of said rim, wherein said core further comprises a box fixed to each of said concave portions of said rim by said bolts;

fixing means wherein a plurality of said electromagnets are disposed at positions spaced about 30 to 45 degrees about the center of rotation of said wheel by said fixing means and are arranged such that their upper edges are at the same level as that of said outer circumferential edges of said rim; and wherein each of said electromagnets further comprises an arcuate electrode insulatedly attached to said hub of said wheel and a stationary brush which contacts with said arcuate electrode for supplying an electric current from said power source, thereby interrupting the energization of said coil means due to a shape of said arcuate electrode when said electromagnet reaches the position of a straight stationary guide which is mounted on said loom body at a position where said flexible tape is separated from said wheel.

8. A flexible type rapier loom according to claim 1, further comprising:

a straight stationary guide mounted on said loom body at a position where said flexible tape is separated from said wheel; and magnetic separating means, provided on said straight stationary guide for separating said flexible tape from said wheel by a magnetic force.

9. A flexible type rapier loom according to claim 1, wherein:

said magnetic attracting means further comprises at least one unit magnet which further comprises at least one thin plate permanent magnet having positive and negative magnetic poles magnetized at both sides thereof, and two yoke plates sandwiching said at least one thin plate permanent magnet, wherein said magnetic attracting means is mounted at said outer circumference of said wheel such that said flexible tape fits thereon and forms a closed circuit magnetic path between said magnetic attracting means and said flexible tape.

10. A flexible type rapier loom according to claim 9, further comprising:

a magnetic separating means comprising a permanent magnet provided on a straight stationary guide which is mounted on said loom body at a position where said flexible tape is separated from said wheel for separating said flexible tape from said wheel by a magnetic force.

11. A flexible type rapier loom according to claim 10, wherein:

said wheel further comprises a hub rotatably mounted on said loom body and oscillatedly driven back and forth, a plurality of spokes projected from said hub, and an annular rim integrally connected to said spokes and having outer circumferential side edges;

said loom further comprises a fitting wherein said one end of said flexible tape is fixed to an outer circumference of said rim by said fitting; and said plurality of magnetic attracting means are disposed at positions spaced about 30 to 45 degrees about the center of rotation of said wheel, wherein each of said magnetic attracting means further comprise three unit magnets in which said at least one permanent magnet comprises a cobalt magnet of a disk shape magnetized thicknesswise with positive and negative poles and sandwiched between two yoke plates and wherein one of said unit magnets is arranged in a groove formed in said rim and wherein the remaining two of said unit magnets are arranged at opposite side edges of said rim such that each of said unit magnets is fitted to said rim by means of bolts and nuts, said unit magents being arranged such that their upper edges are at the same level as that of said outer circumferential edges of said rim.

12. A flexible type rapier loom according to claim 9, wherein:

said wheel further comprises a hub rotatably mounted on said loom body and oscillatedly driven back and forth, a plurality of spokes projected from said hub, and an annular and corrugated rim having a plurality of concaved portions, said rim being integrally connected to said spokes and having outer circumferential edges;

said loom further comprising a fitting wherein said one end of said flexible tape is fixed to an outer circumference of said rim by said fitting; and a plurality of bolts, wherein each of said magnetic attracting means is disposed at each concave portion of said rim, wherein said core further comprises a box fixed to each of said concave portions of said rim by said bolts and three unit magnets in which said at least one permanent magnet comprises a cobalt magnet of a disk shape magnetized thicknesswise with positive and negative poles and sandwiched between two yoke plates, said box and said unit magnets being arranged such that their upper edges are at the same level as that of said outer circumferential edges of said rim.

13. A flexible type rapier loom according to claim 11 or 12, wherein said at least one permanent magnet further comprises three permanent magnets.

14. A flexible type rapier loom according to claim 1, wherein:

said magnetic attracting means further comprises a plurality of U-shaped permanent magnets, and wherein said permanent magnets are provided on said wheel, said wheel being interposed between two leg portions of said permanent magnets.

15. A flexible type rapier loom according to claim 14, wherein:

said wheel further comprises a hub rotatably mounted on said loom body and oscillatedly driven back and forth, a plurality of spokes projected from said hub, and an annular rim integrally connected to said spokes;

said loom further comprising a fitting wherein said one end of said flexible tape is fixed to an outer circumference of said rim by means of said fitting; and fixing means wherein said plurality of U-shaped magnets are disposed at positions spaced about 30 to 45 degrees about the center of rotation of said wheel by said fixing means and are arranged such that tip portions of said leg portions thereof are at the same level as that of said outer circumferential edges of said rim.

* * * * *